US006388210B1

(12) United States Patent
Nisse

(10) Patent No.: US 6,388,210 B1
(45) Date of Patent: May 14, 2002

(54) OPERATING ELEMENT FOR SELECTIVELY PRODUCING ELECTRIC CONTACTS

(75) Inventor: Olav Nisse, Hildesheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/529,321

(22) PCT Filed: Aug. 11, 1999

(86) PCT No.: PCT/DE99/02511

§ 371 Date: Jun. 21, 2000

§ 102(e) Date: Jun. 21, 2000

(87) PCT Pub. No.: WO00/10185

PCT Pub. Date: Feb. 24, 2000

(30) Foreign Application Priority Data

Aug. 13, 1998 (DE) ..... 198 36 793

(51) Int. Cl.[7] ..... H01H 25/04
(52) U.S. Cl. ..... 200/6 A; 200/310
(58) Field of Search ..... 200/4, 5 R, 6 A, 200/120, 18, 310, 313, 317, 315

(56) References Cited

U.S. PATENT DOCUMENTS

| | | | | | |
|---|---|---|---|---|---|
| 3,965,315 | A | | 6/1976 | Wuenn | 200/6 A |
| 4,866,221 | A | | 9/1989 | Obermann et al. | 200/5 R |
| 4,947,461 | A | | 8/1990 | Yoshioka et al. | 200/5 R |
| 5,689,095 | A | * | 11/1997 | Kawase | 200/5 R |
| 5,744,765 | A | * | 4/1998 | Yamamoto | 200/6 A |
| 5,813,519 | A | * | 9/1998 | Gotoh | 200/313 |
| 5,952,628 | A | * | 9/1999 | Sato et al. | 200/4 |
| RE36,738 | E | * | 6/2000 | Matsumiya et al. | 200/6 A |
| 6,162,999 | A | * | 12/2000 | Ishikawa et al. | 200/6 A |
| 6,246,019 | B1 | * | 6/2001 | Nakamura et al. | 200/6 A |

FOREIGN PATENT DOCUMENTS

| | | | |
|---|---|---|---|
| DE | 195 35 423 | 3/1997 | H03K/17/965 |
| EP | 0 337 045 | 3/1989 | H01H/25/04 |

* cited by examiner

*Primary Examiner*—Michael Friedhofer
(74) *Attorney, Agent, or Firm*—Kenyon & Kenyon

(57) ABSTRACT

A control element for selectively establishing electrical contacts, having a grip, a contact mat with at least two contact elements, at least one resetting, element for each contact element, and a p.c. board, with a movement of the grip selectively establishing an electrical contact between a contact element on the contact mat and the p.c. board, and a resetting force being applied to the grip by the at least one resetting element of a contact element.

15 Claims, 2 Drawing Sheets

OPERATING ELEMENT FOR SELECTIVELY PRODUCING ELECTRIC CONTACTS

FIELD OF THE INVENTION

The present invention relates to a control element for selectively establishing electrical contacts. In particular, the present invention concerns a four-way rocker, preferably for use in car radios.

BACKGROUND INFORMATION

In the case of electronic devices that have small user interfaces, such as car radios and other consumer electronic equipment, the numerous functions need to be controlled by compact control elements that combine a variety of electrical switching functions in a single unit. Despite their compact design, control elements of this type need to be constructed so that multiple electrical contacts are not inadvertently closed simultaneously during operation, causing the device to operate in an uncontrolled manner.

In addition, a control element of this type must last a long time. The target is a service life covering several hundred thousand actuations per switch position. The control element haptic properties, i.e., the force and distance traveled to trigger an electrical contact, must meet defined standards to convey a reliable switching sensation to the user.

Control elements of this type in the form of pushbutton switches are known in the related art, for example the element described in German Patent No. 195 35 423. The pushbutton switches described in this publication have a depression in their underside that rests on a round seating.

Pressure applied to one side by the user causes the pushbutton switch to tilt and activate momentary-contact switches arranged around the round seating. Retaining ribs between the individual momentary-contact switches guide the tilting motion of the pushbutton switch and ensure that only one momentary-contact switch can be triggered at a time. The momentary-contact switches are mounted on a p.c. board that is connected to the device electronics.

However, this control element has the following disadvantages: due to the location of the pushbutton switch acting from above upon the momentary-contact switches mounted on the p.c. board, the control element must be mounted at a great overall depth, in particular because the tilting motion of the pushbutton switch must first be guided in the appropriate direction by the retaining ribs before it can actuate one of the momentary-contact switches. When more than two momentary-contact switches are used, the retaining ribs also frequently prevent any electrical contact from being established at all, with the pushbutton switch merely bumping into the retaining ribs instead. Finally, the electromechanical momentary-contact switches have a considerably limited service life, which limits the life of the overall pushbutton switch.

SUMMARY OF THE INVENTION

The control element according to the present invention for selectively establishing electrical contacts has the advantage that the use of a contact mat which structurally separates the resetting elements from the contact elements enables both of these components to be independently optimized for their own specific applications. The resetting elements, which are provided on the contact mat and return the switch grip to the neutral position after selectively establishing an electrical contact, provide a reliable switching sensation during operation. The contact elements, which are also provided on the contact mat, are operated largely without force and are designed for several hundred thousand switching cycles. The one or more assigned resetting elements protect them against excessive mechanical load.

By replacing the momentary-contact switches with a contact mat that interacts directly with the p.c. board, the control element can have a very flat overall shape, thus saving space. A further advantage of using a contact mat is that it has a long service life, ensuring that the overall control element will also last a long time. The small number of individual parts in the control element also enables the component to be assembled easily and therefore economically.

According to one preferred embodiment, the contact mat is made of an elastic material, such as silicone, which retains the necessary flexibility even after many switching operations. The control element grip preferably includes a rocker on the side facing the user, behind which is provided a contact frame which transmits the movements of the rocker to the contact mat. To apply a uniform resetting force to the contact frame, each contact element is preferably surrounded on the contact mat by preferably two resetting elements which return the contact frame, and thus the rocker, to the initial position. The resetting elements are preferably formed by raised areas on the contact mat, referred to as contact domes, which are pressed together flexibly by the contact frame.

The rocker is preferably mounted so that it tilts in total of four directions. However, it is also possible to provide correspondingly more tilting directions. Four contact elements, which operate in the different directions during tilting, are preferably correspondingly provided on the contact mat.

DETAILED DESCRIPTION

Figure 1:
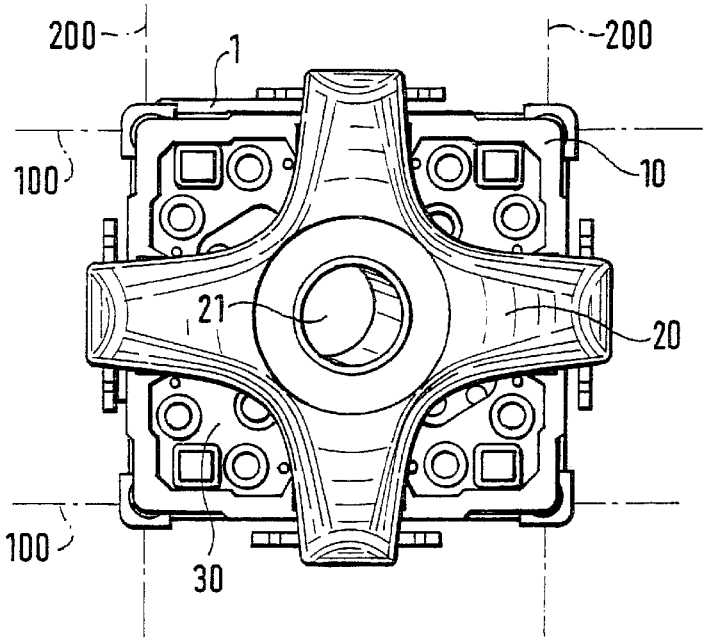
FIG. 1 shows a top view of the control element.

As shown in FIG. 1, a preferred embodiment of the control element according to the present invention has a switch holder 1 in which a contact mat 30 is provided beneath a contact frame 10. A rocker 20, preferably essentially in the shape of a cross, is mounted on the outside of switch holder 1. A p.c. board 40 (see FIGS. 4 and 5), which connects the control element to the device electronics, is attached to the back of switch holder 1.

Figure 4:
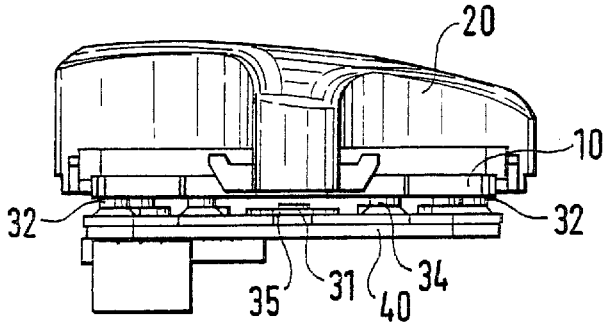
FIG. 4 shows a side view of the control element in the neutral position.
Figure 5:
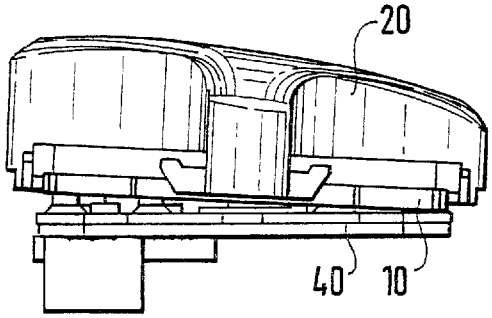
FIG. 5 shows a side view of the control element during switching.

Rocker 20 clips onto switch holder 1, i.e., it latches into place behind small hooks (not visible) which are provided in the center of the outer side surfaces of switch holder 1. On its underside, rocker 20 has four plungers (not visible) which transmit the rocker movements to underlying contact frame 10. The front of the rocker can have any desired design without influencing the control element functionality. For example, FIGS. 4 and 5 show one embodiment that has a slightly inclined surface. Central opening 21 shown in FIG. 1 enables the rocker to be backlit by one or more LEDs (not illustrated), enabling the control element to be operated reliably even in the dark.

Figure 2:
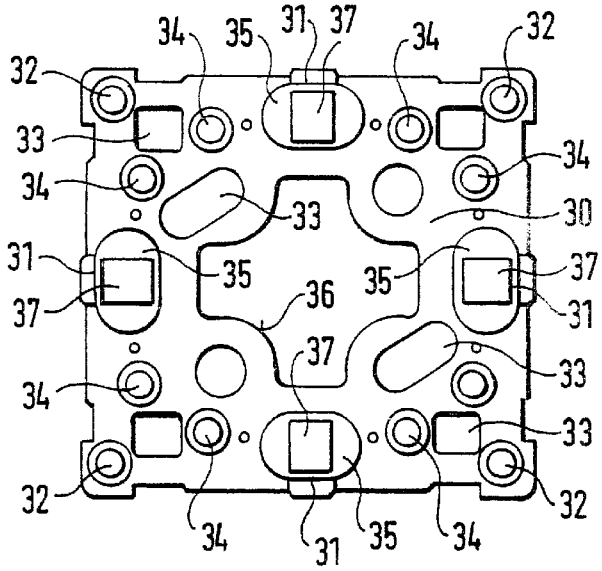
FIG. 2 shows the contact mat.
Figure 3:
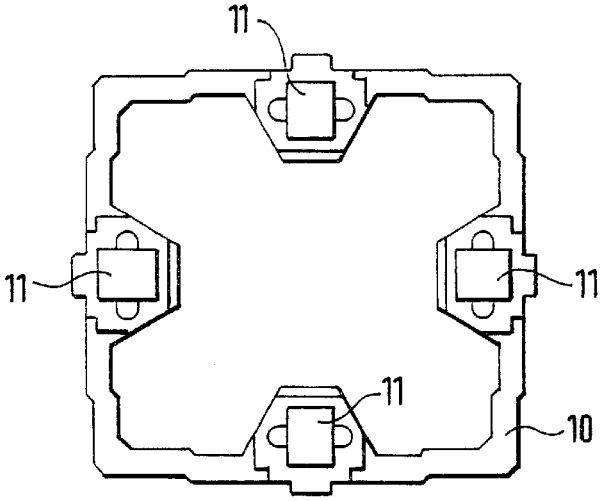
FIG. 3 shows the contact frame according to a preferred embodiment.

According to the preferred embodiment illustrated in FIGS. 1 and 3, contact frame 10 has an essentially square shape. In its idle position, the four corners of this square lie on top of four resetting elements 32 (see FIG. 2) on contact mat 30. Four enlarged areas 11, which are pressed against underlying pressure areas 37 of contact elements 31 on contact mat 30 when contact frame 10 tilts, are provided in the center of the four sides of contact frame 10. The arrangement of resetting elements 32 in the corners of contact mat 30 lends maximum stability to the seating of contact frame 10. When rocker 20 tilts, two of the four resetting elements 32 are pressed together simultaneously and, without causing any skewing, apply the necessary resetting force to return contact frame 10, and thus rocker 20, to the initial position. The contact frame inclination preferably does not exceed 2 degrees (see FIG. 5) so that force is applied to resetting elements 32 from above at an essentially perpendicular angle.

In addition to designing contact frame 10 in the shape of a square, an embodiment that follows the basic contour of rocker 20 is also conceivable, thus providing more space for additional individual switches in the corners of switch holder 1 (see below). In this case, resetting elements 32 are arranged closer to the central area of the sides of contact mat 30.

Contact mat 30 (see FIG. 2) performs multiple functions in the preferred embodiment of the control element according to the present invention. Raised areas, referred to as contact domes, which form resetting elements 32 for contact frame 10, are provided in the corners of preferably square-shaped contact mat 30. These raised areas are preferably circular in shape and rise 1–2 mm above the plane of contact mat 30 at an approximately 45 degree angle. This ensures that the control element maintains its desired haptic properties over a service life of several hundred thousand switching operations.

In addition, four contact elements 31 are provided preferably in the centers of the sides of preferably square contact mat 10. Contact elements 31 each include an oval raised area 35 (see also FIG. 4), on which is provided a pressure area 37 over which contact frame 10 presses contact surfaces (not visible) located on the bottom of contact mat 30 against corresponding contact surfaces (not visible) on p.c. board 40, thereby establishing the desired electrical contact. Because the resetting force is generated by contact domes 32, the contact between the two contact surfaces is largely without force, instead using a contact travel of preferably around 0.3 mm. The contact surfaces are preferably made of a printed electrically conductive varnish or small graphite surfaces embedded in the contact mat.

In the corners of contact mat 30 are preferably provided additional switching domes 34, which can perform the function of resetting elements and contact elements (with corresponding conductive contact surfaces on the bottom of contact mat 30) for additional individual switches (not illustrated) provided in these locations. Numerous small openings 33 and large recess 36 in the center enable rocker 20 and the optional individual switches to be back-lit by LEDs mounted on p.c. board 40. The shape and arrangement of the openings in FIG. 2 are only one possible embodiment and are determined specifically by the LEDs used and by the desired control element design.

P.c. board 40 (see FIGS. 4 and 5) is attached to switch holder 1 (not illustrated in FIGS. 4 and 5) from the rear. The p.c. board is preferably screwed onto switch holder 1, although clipping and gluing are other possible attachment methods. The contact surfaces (not visible) that produce the electrical contact when they touch the corresponding contact surfaces on contact mat 30 are provided on the p.c. board. For this purpose, two printed conductors with two meanders are preferably wound closely around each other without touching. However, the electrical connection is established when the contact surface on the contact mat simultaneously touches the two conductors.

Figure 6:
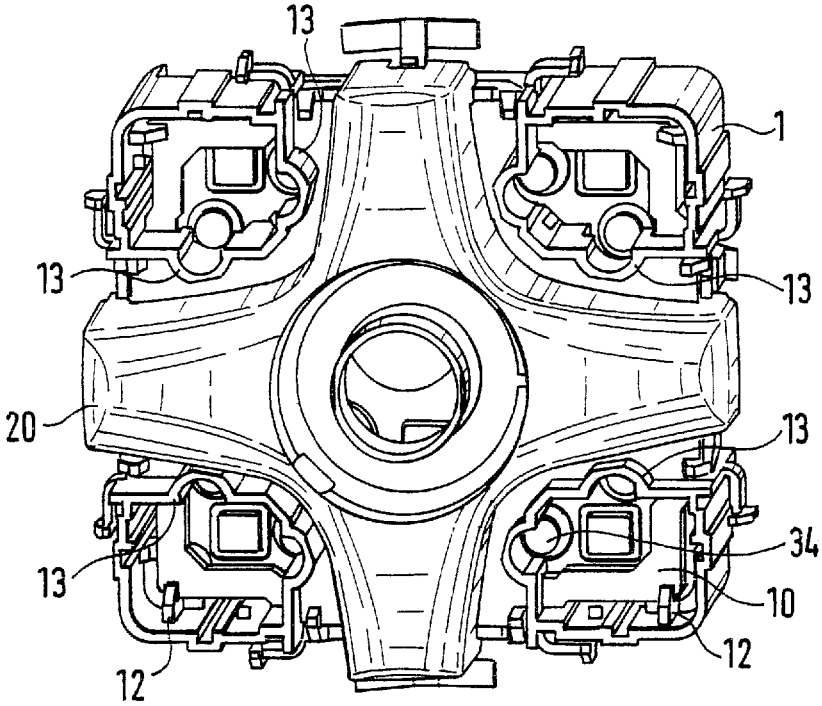
FIG. 6 shows a representation in perspective of a second preferred embodiment of the control element.

FIG. 6 shows a perspective view of the overall arrangement. In addition to the components described above, switch frame 1 also has small projections 12 (in each corner of switch holder 1) which limit the vertical position of contact frame 10 in switch holder 1 in the upward direction. As a result, contact frame 10 can move only by rotating around the pairs of rotational axes 100 and 200 illustrated in FIG. 1. Contact frame 10 is pressed backward in the direction of the p.c. board along one of its preferably four sides, while the opposite side of contact frame 10 remains in its original position.

When p.c. board 40 is screwed on from the rear, contact mat 30 is clamped between p.c. board 40 and contact frame 10. This slightly prestresses switching domes 32, preventing contact frame 10 and rocker 20 from remaining fixed in place and rattling in the neutral position.

The modified embodiment of the control element illustrated in FIG. 6 also has additional webs 13 which not only guide the movement of possible additional individual switches that can be arranged in the corners of the control element, but also shield scattered light from the LEDs (not illustrated) located behind the individual switches.

Switch holder 1 and rocker 20 are preferably made of plastic by injection molding. To prevent contact frame 10 from bending between its contact points, i.e., contact domes 32 provided at the corners, the frame must meet particularly high rigidity requirements. It is therefore preferably produced by zinc die-casting. Silicone, in particular, is a suitable material for contact mat 30, since its material properties retain the necessary flexibility even after many switching cycles.

What is claimed is:

1. A control element for selectively establishing an electrical contact, comprising:

a p.c. board;

a grip;

a contact mat;

at least two contact elements situated on the contact mat, a movement of the grip selectively establishing an electrical contact between at least one of the at least two contact elements and the p.c. board; and at least one resetting element associated with each of the at least two contact elements, the at least one resetting element being situated on the contact mat and being spaced from each of the at least two contact elements, the at least one resetting element applying a resetting force to the grip.

2. The control element according to claim 1, wherein the contact mat is composed of silicone.

3. The control element according to claim 1, wherein the grip includes a rocker and a contact frame, the contact frame transmitting movements of the rocker to the contact mat.

4. The control element according to claim 3, further comprising a switch holder, the rocker being rotatably attached to the switch holder, the switch holder holding the contact frame, the contact mat and the p.c. board.

5. The control element according to claim 4, wherein the switch holder provides additional space for switches situated on the contact mat for operating contact domes.

6. The control element according to claim 3, wherein the contact mat has openings for LEDs mounted on the p.c. board to back-light the rocker and switches.

7. The control element according to claim 1, wherein the at least two contact elements include four contact elements.

8. The control element according to claim 1, wherein the at least one resetting element includes a contact dome on the contact mat.

9. The control element according to claim 1, wherein the at least two contact elements include electrically conductive contact surfaces that are pressed against corresponding contact points on the p.c. board to establish the electrical contact.

10. The control element according to claim 1, wherein the at least one resetting element includes two resetting elements associated respectively with each of the at least two contact elements.

11. The control element according to claim 10, wherein the two resetting elements are evenly spaced apart on opposite sides of each of the at least two contact elements.

12. A control element for selectively establishing an electrical contact, comprising:

a p.c. board;

a grip;

a contact mat;

at least two contact elements situated on the contact mat, a movement of the grip selectively establishing an electrical contact between at least one of the at least two contact elements and the p.c. board; and at least one resetting element associated with each of the at least two contact elements, the at least one resetting element being situated on the contact mat, the at least one resetting element applying a resetting force to the grip, wherein the at least one resetting element includes two resetting elements associated with each of the at least two contact elements.

13. The control element according to claim 12, wherein the two resetting elements are evenly spaced apart on opposite sides of each of the at least two contact elements.

14. A control element for selectively establishing an electrical contact, comprising:

a p.c. board;

a grip, wherein the grip includes a rocker and a contact frame, the contact frame transmitting movements of the rocker to the contact mat;

a contact mat;

at least two contact elements situated on the contact mat, a movement of the grip selectively establishing an electrical contact between at least one of the at least two contact elements and the p.c. board, wherein the movement of the grip is limited so that an inclination of the contact frame does not exceed 2 degrees; and at least one resetting element associated respectively with each of the at least two contact elements, the at least one resetting element being situated on the contact mat, the at least one resetting element applying a resetting force to the grip.

15. A control element for selectively establishing an electrical contact, comprising:

a p.c. board;

a grip;

a contact mat;

at least two contact elements situated on the contact mat, a movement of the grip selectively establishing an electrical contact between at least one of the at least two contact elements and the p.c. board, wherein a travel of the at least one of the at least two contact elements in response to the movement of the grip is limited to 0.3 mm; and at least one resetting element associated respectively with each of the at least two contact elements, the at least one resetting element being situated on the contact mat, the at least one resetting element applying a resetting force to the grip.

* * * * *